US010830103B2

(12) United States Patent
Mohammed et al.

(10) Patent No.: US 10,830,103 B2
(45) Date of Patent: Nov. 10, 2020

(54) EXPANSION JOINT AND METHODS OF ASSEMBLING THE SAME

(71) Applicant: General Electric Company, Schenectady, NY (US)

(72) Inventors: Javeed Iqbaluddin Mohammed, Karnataka (IN); Pallab Karmakar, Karnataka (IN); Bradly Aaron Kippel, Greenville, SC (US)

(73) Assignee: General Electric Company, Schenectady, NY (US)

( * ) Notice: Subject to any disclaimer, the term of this patent is extended or adjusted under 35 U.S.C. 154(b) by 202 days.

(21) Appl. No.: 15/994,375

(22) Filed: May 31, 2018

(65) Prior Publication Data

US 2019/0010827 A1 Jan. 10, 2019

(30) Foreign Application Priority Data

Jul. 5, 2017 (IN) ..... 201741023636

(51) Int. Cl.

| | |
|---|---|
| ***F01D 11/00*** | (2006.01) |
| ***F01D 25/26*** | (2006.01) |
| ***F01D 25/32*** | (2006.01) |
| *F01D 25/00* | (2006.01) |

(52) U.S. Cl.

CPC ..... *F01D 25/26* (2013.01); *F01D 11/005* (2013.01); *F01D 25/32* (2013.01); *F01D 25/005* (2013.01); *F05D 2220/32* (2013.01); *F05D 2230/60* (2013.01); *F05D 2230/642* (2013.01); *F05D 2240/12* (2013.01); *F05D 2240/55* (2013.01); *F05D 2250/75* (2013.01); *F05D 2260/30* (2013.01); *F05D 2260/38* (2013.01);

(Continued)

(58) Field of Classification Search

CPC ..... F01D 25/26; F01D 11/005; F01D 25/30; F01D 11/00; F01D 25/32; F01D 25/005; F05D 2230/642; F05D 2300/501; F05D 2250/75; F05D 2260/38; F05D 2240/55; F05D 2220/32; F05D 2300/171; F05D 2260/30; F05D 2240/12; F05D 2230/60; F05D 2260/941

See application file for complete search history.

(56) References Cited

U.S. PATENT DOCUMENTS 3,721,460 A * 3/1973 Holman et al. ..... B64D 33/02 285/148.19
4,318,668 A * 3/1982 Chaplin ..... F01D 25/14 415/135

(Continued)

FOREIGN PATENT DOCUMENTS

EP 1705343 B1 1/2012
EP 1873426 B1 4/2013

*Primary Examiner* — Moshe Wilensky
*Assistant Examiner* — Brian Christopher Delrue
(74) *Attorney, Agent, or Firm* — Charlotte C. Wilson; James W. Pemrick

(57) ABSTRACT

An expansion joint for use between a turbine duct and a diffuser duct includes a first flange coupled to the turbine duct, a second flange coupled to the diffuser duct, and a flexible element positioned between and coupled to the first flange of the turbine duct and the second flange of the diffuser duct. The flexible element defines a trough for receiving a liquid therein. The trough includes a drain pipe configured to channel the liquid away from the trough.

15 Claims, 6 Drawing Sheets

(52) U.S. Cl.
CPC .. *F05D 2260/941* (2013.01); *F05D 2300/171* (2013.01); *F05D 2300/501* (2013.01)

(56) References Cited

U.S. PATENT DOCUMENTS 4,791,980 A * 12/1988 Hagar ..... F28D 19/047 165/9
4,867,634 A * 9/1989 Baker ..... F01D 25/32 415/121.2
5,088,775 A * 2/1992 Corsmeier ..... F02K 1/805 285/374
5,221,096 A * 6/1993 Heldreth ..... F01D 11/005 277/630
5,400,586 A * 3/1995 Bagepalli ..... F01D 9/023 60/800
5,443,290 A * 8/1995 Boyer ..... F16L 27/10 277/625
6,065,756 A * 5/2000 Eignor ..... F01D 11/005 277/545
6,076,835 A * 6/2000 Ress ..... F01D 11/005 277/637
6,418,727 B1 * 7/2002 Rice ..... F01D 9/023 60/799
6,464,457 B1 * 10/2002 Morgan ..... F01D 11/005 277/630
6,807,803 B2 * 10/2004 Poccia ..... F02K 1/822 60/39.5
6,895,757 B2 * 5/2005 Mitchell ..... F01D 11/005 60/753
7,040,098 B2 * 5/2006 Lepretre ..... F01D 11/005 415/214.1
7,527,469 B2 * 5/2009 Zborovsky ..... F01D 9/041 277/412
7,594,792 B2 * 9/2009 Audeon ..... F01D 11/005 277/630
7,793,507 B2 * 9/2010 Poccia ..... F01D 25/30 277/411
7,966,808 B2 * 6/2011 Tsou ..... F01D 11/003 244/110 B
8,070,427 B2 12/2011 Snook et al.
8,157,509 B2 * 4/2012 Black ..... F01D 25/30 415/126
8,800,300 B2 * 8/2014 Hashimoto ..... F01D 25/30 239/265.11
9,206,705 B2 * 12/2015 Hashimoto ..... F01D 11/003
9,228,533 B2 1/2016 Roberts et al.
9,284,889 B2 * 3/2016 Damgaard ..... F02K 1/805
9,488,110 B2 * 11/2016 Chan ..... F02C 7/28
9,771,818 B2 * 9/2017 Budnick ..... F01D 11/005
9,828,868 B2 * 11/2017 Guinn ..... F01D 11/005
2002/0163134 A1 * 11/2002 Cromer ..... F01D 9/023 277/411
2004/0041355 A1 * 3/2004 Suzuki ..... B65D 53/02 277/650
2006/0123797 A1 * 6/2006 Zborovsky ..... F01D 9/041 60/800
2007/0025841 A1 * 2/2007 Milazar ..... F01D 11/005 415/134
2008/0053107 A1 * 3/2008 Weaver ..... F01D 9/023 60/800
2008/0060362 A1 * 3/2008 Poccia ..... F01D 25/30 60/772
2008/0166233 A1 * 7/2008 Johnson ..... B23P 6/002 415/230
2012/0023897 A1 * 2/2012 DeDe ..... F02C 7/25 60/39.094
2015/0330241 A1 * 11/2015 Chuong ..... F01D 11/001 415/173.1
2015/0354386 A1 * 12/2015 Chuong ..... F01D 25/30 415/182.1
2016/0102608 A1 * 4/2016 Lynn ..... F01D 25/24 60/787

* cited by examiner

EXPANSION JOINT AND METHODS OF ASSEMBLING THE SAME

BACKGROUND

The present application relates generally to gas turbine engines, and more particularly to an expansion joint for use between a turbine duct and a diffuser duct of the gas turbine engine.

At least some known gas turbine engines have an expansion joint located between a turbine duct flange (e.g., an exhaust frame) and an exhaust diffuser duct. The exhaust diffuser duct facilitates expanding the exhaust gases from the gas turbine engine to achieve aerodynamic pressure recovery. Typically, the gas turbine engine turbine duct and the turbine duct flange are hot during operation of the gas turbine engine. In addition, typical exhaust diffuser ducts are fabricated casings that are internally insulated and relatively cold. As such, because of the thermal mismatch between components at this connection, an expansion joint is typically used to facilitate the relative displacement between these components due to thermal expansion/contraction during operation of the gas turbine engine.

At least some known expansion joints in gas turbine engines use an expansion joint belt arrangement including a ceramic fiber composite belt. One end of the belt is bolted to a frame attached to the gas turbine engine and the other end is bolted to a frame of the exhaust diffuser duct. In addition, some known expansions joints include flex seal plates with a collection trough for water wash fluid and/or liquid fuel that may enter the diffuser after a false start. The expansion joint belt may experience problems including cracked frames due to thermal transients; burned belts due to frames cracking and bolster bag failure; and leakage during gas turbine water wash cycles which not only allows contaminated water to leak onto the ground, but also damages the ceramic fibers in the belt. The flex seal expansion joint has a complex arrangement of clamping and sealing systems, which require the use of numerous parts. Moreover, the separate trough system requires several clamp bars during assembly.

BRIEF DESCRIPTION

In one aspect, an expansion joint for use between a turbine duct and a diffuser duct is provided. The expansion joint includes a first flange coupled to the turbine duct, a second flange coupled to the diffuser duct, and a flexible element positioned between and coupled to the first flange of the turbine duct and the second flange of the diffuser duct. The flexible element defines a trough for receiving a liquid therein. The trough includes a drain pipe configured to channel the liquid away from the trough.

In another aspect, a gas turbine engine is provided. The gas turbine engine includes a turbine duct having a first flange coupled to a downstream portion of the turbine duct. The gas turbine engine also includes a diffuser duct having a second flange coupled to an upstream portion of the diffuser duct. In addition, the gas turbine engine includes an expansion joint extending between the turbine duct and the diffuser duct. The expansion joint includes a plurality of flexible seals coupled to the first flange and the second flange. Moreover, the expansion joint defines a trough for receiving a liquid therein. The trough includes a drain pipe configured to channel the liquid away from the trough.

In another aspect, a method of assembling an expansion joint for use between a turbine duct and a diffuser duct is provided. The method includes coupling a first flange to the turbine duct, and coupling a second flange to the diffuser duct. In addition, the method includes coupling a flexible element to the first flange of the turbine duct and the second flange of the diffuser duct. The flexible element defines a trough for receiving a liquid therein. Moreover, the method includes coupling a drain pipe to the trough to channel the liquid away from the trough.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
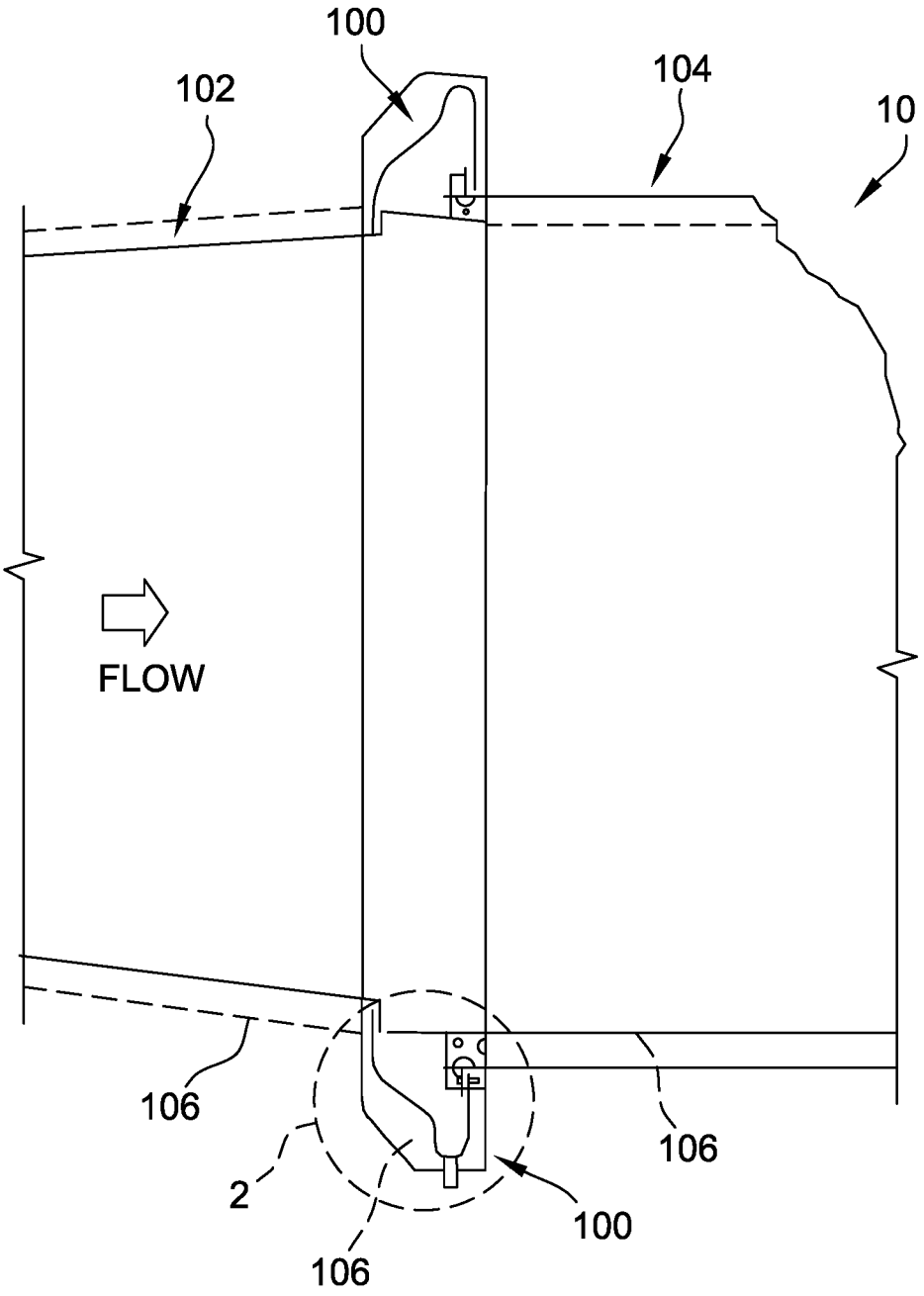
FIG. 1 is a partial side schematic showing a flexible expansion joint positioned between a turbine duct and a diffuser duct of a gas turbine engine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Approximating language may be applied to modify any quantitative representation that could permissibly vary without resulting in a change in the basic function to which it is related. Accordingly, a value modified by a term or terms, such as "about," "approximately," and "substantially," is not to be limited to the precise value specified. In at least some instances, the approximating language may correspond to the precision of an instrument for measuring the value. Here and throughout the specification and claims, range limitations are identified. Such ranges may be combined and/or interchanged, and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

The exemplary components and methods described herein overcome at least some of the disadvantages associated with known combustor assemblies for gas turbine engines. The embodiments described herein include an expansion joint for use between a turbine duct and an exhaust diffuser duct of a gas turbine engine. The expansion joint includes a plurality of flexible seals attached to a flange attached to the turbine duct and the exhaust diffuser duct. The flexible seals provide a collection trough for receiving water wash fluid and/or liquid fuel that may enter the exhaust diffuser after a false start. In addition, the flexible seals accommodate relative movement between the gas turbine engine turbine duct and the exhaust diffuser duct during operation of the gas turbine engine due to thermal expansion and/or contraction of the components.

FIG. 1 is a partial side schematic of a gas turbine engine 10 showing a flexible expansion joint 100 positioned between a turbine duct 102 and a diffuser duct 104. In the exemplary embodiment, turbine duct 102 is a gas turbine exhaust duct, while diffuser duct 104 is an adjacent exhaust ductwork extending away from gas turbine engine 10. The area about the expansion joint between the turbine duct 102 and diffuser duct 104 may be covered by internal and/or external thermal insulation 106 (shown in phantom), for example, and without limitation, one or more layers of ceramic fiber insulation, thermal insulation blankets, and the like.

Figure 2:
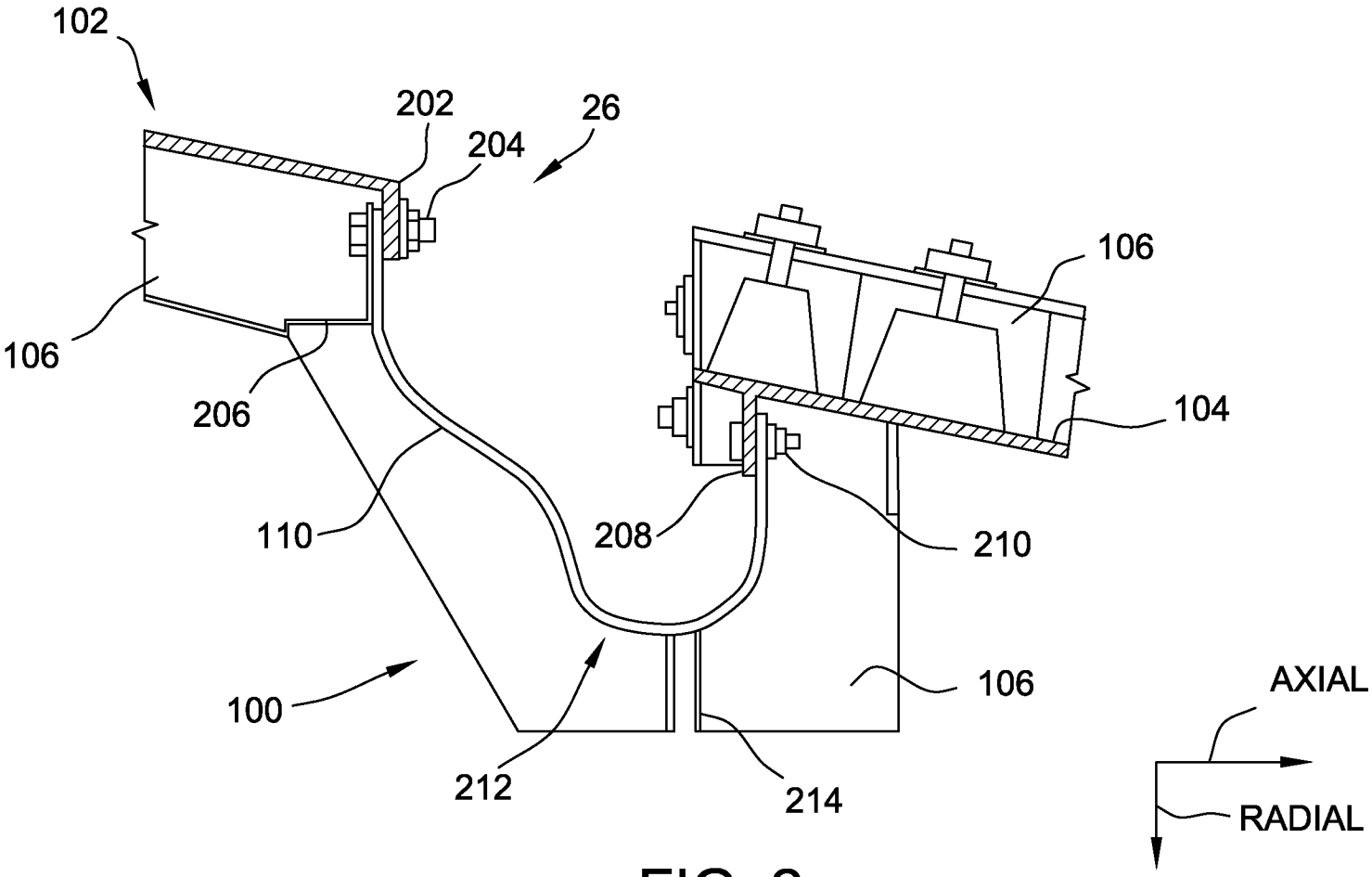
FIG. 2 is an enlarged detail view of the flexible expansion joint shown in FIG. 1.

FIG. 2 is an enlarged detail view of flexible expansion joint 100 taken from FIG. 1. In the exemplary embodiment, flexible expansion joint 100 includes a flexible element 110. In particular, flexible element 110 includes a plurality of relatively thin flexible sheet components (i.e., flexible seals) (not shown in FIG. 2) coupled together to form flexible element 110. Specifically, flexible element 110 includes a plurality of Inconel sheet components of varying thickness. Inconel is a nickel based super alloy that has high oxidation and corrosion resistance. Alternatively, flexible element 110 includes a plurality of flexible seals fabricated from stainless steel. Alternatively, flexible element 110 includes a plurality of flexible seals fabricated from any flexible material or similar material that enable expansion joint 100 to function as described herein.

In the exemplary embodiment, flexible element 110 is coupled to one end to turbine duct 102. Turbine duct 102 may be of conventional design. In particular, flexible element 110 is attached to turbine duct 102 at a radial flange 202. In the exemplary embodiment, flexible element 110 is secured to flange 202 by a plurality of fastener assemblies 204 (e.g., nut, bolt, clamping-down bar, and washer assemblies or similar fastening components). In some embodiments, one or more insulation retaining clips 206 are coupled to the opposite side of flange 202, if desired.

In the exemplary embodiment, flexible element 110 is also attached to diffuser duct 104. Diffuser duct 104 may be of conventional design. Alternatively, other types of exhaust diffuser ducts may be used. In the exemplary embodiment, flexible element 110 is attached to a radial flange 208 of diffuser duct 104. In the exemplary embodiment, flexible element 110 is secured to flange 208 by a plurality of fastener assemblies 210 (e.g., nut, bolt, clamping-down bar, and washer assemblies or similar fastening components). A drainage trough portion 212 or similar type of structure of flexible element 110 is defined by the shape of flexible element 110, and is located between turbine duct 102 and diffuser duct 104. In the exemplary embodiment, drainage trough portion 212 defines an annular drainage trough which captures any water and/or fuel running along the inside of turbine duct 102. Drainage trough portion 212 includes a drain pipe 214 at the lowermost, i.e. radially innermost, point of drainage trough portion 212. Drain pipe 214 is configured to channel any collected water and/or liquid fuel to an appropriate location.

In operation, the curved profile sectional shape of flexible element 110, as shown in FIG. 2, enables flexible element 110 to adjust to relative movement between turbine duct 102 and diffuser duct 104. For example, in one embodiment, the relative movement between turbine duct 102 and diffuser duct 104 is approximately 4 inches (in.) in the axial direction and approximately 1.5 in. in the radial direction. Flexible element 110 is configured to flex to accommodate such movement.

Figure 3:
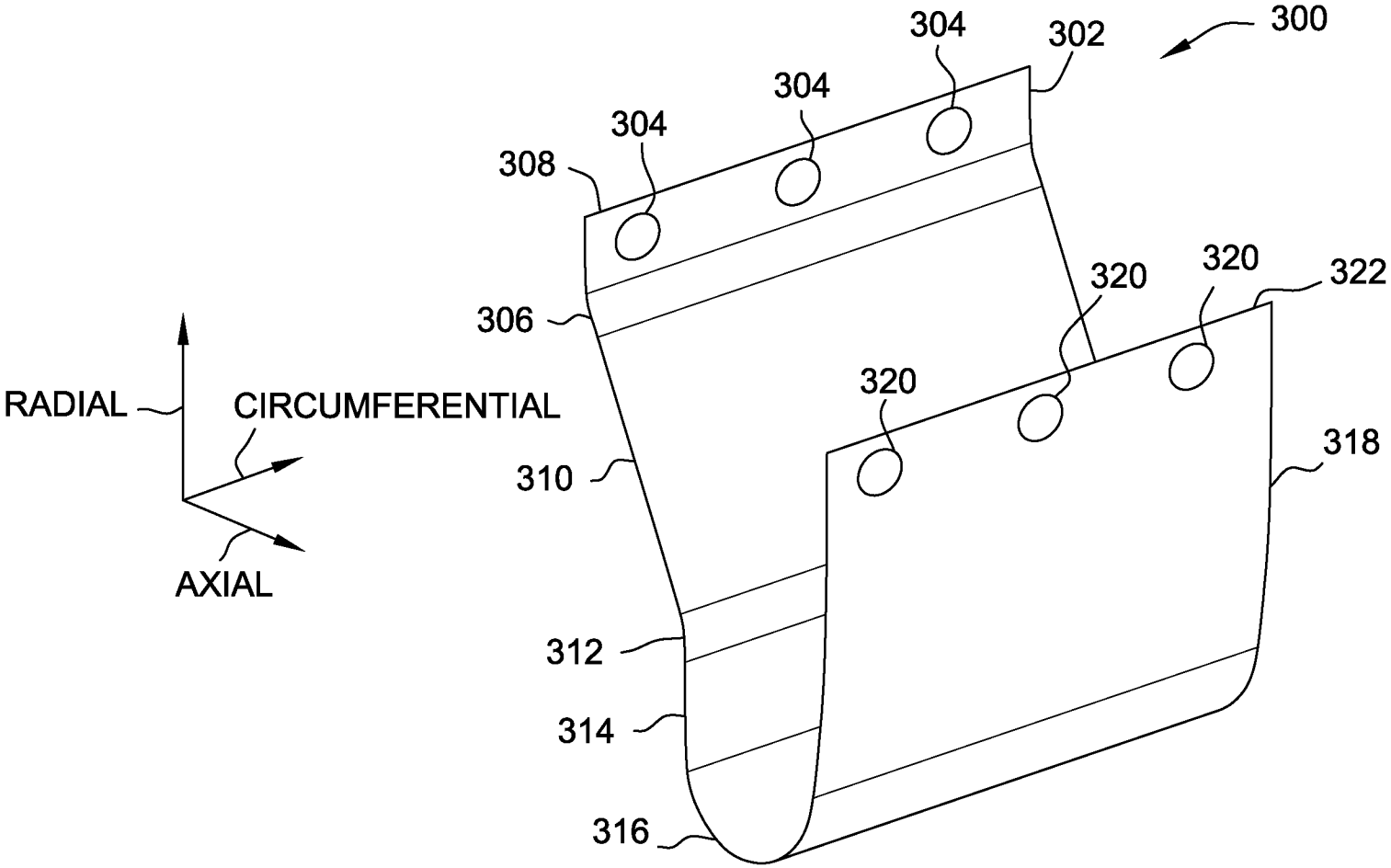
FIG. 3 is a perspective view of a thin flexible seal for use with a flexible element of the expansion joint shown in FIG. 2.

FIG. 3 is a perspective view of a thin flexible seal 300 for use with flexible element 110 (shown in FIG. 2). In the exemplary embodiment, as described above, the curved profile is configured to accommodate the thermal expansion and contraction demands between turbine duct 102 (shown in FIG. 1) and diffuser duct 104 (shown in FIG. 1). Thin flexible seal 300 is typically fabricated from a single sheet component (e.g., a single sheet of material), such as Inconel or stainless steel sheet having a predetermined thickness (not shown) as described above. Thin flexible seal 300 includes a generally flat flange portion 302 including three substantially equidistant mounting apertures 304 extending therethrough. Flange portion 302 extends generally perpendicular to the direction of flow (shown in FIGS. 1 and 2) through gas turbine engine 10 (shown in FIG. 1). A first bend radius 306 (or radius of curvature) is defined longitudinally in thin flexible seal 300 generally parallel to and radially outward of an upstream edge 308 of thin flexible seal 300. As such, thin flexible seal 300 bends aftward and includes a generally angled first flat portion 310 that extends radially outward and aftward from flange portion 302. Thin flexible seal 300 includes a second bend radius 312 defined therein, generally parallel to and radially outward of first bend radius 306. Second bend radius 312 facilitates defining a second flat portion 314 that extends substantially radially outward and perpendicular to the direction of flow (i.e., flange portion 302 and second flat portion 314 are generally parallel). A third bend radius 316, generally the trough portion, is defined in thin flexible seal 300. Third bend radius 316 is substantially 180 degrees. An aft wall 318 extends generally radially inward from third bend radius 316 to a downstream edge 322. Thin flexible seal 300 includes three substantially equidistant mounting apertures 320 extending through aft wall 318 proximate downstream edge 322.

In the exemplary embodiment, the first, second, and third bend radiuses are configured to reduce the stress and strain on thin flexible seal 300, based on the predetermined thickness of the sheet material used to fabricate thin flexible seal 300. In particular, the bend radiuses are selected to facilitate optimizing the low cycle fatigue (LCF) of expansion joint 100. LCF is a life-limiting degradation mode in gas turbines.

It is caused by cyclic, thermal, and mechanical loads associated with gas turbine start-up, operation, and shutdown cycles.

As described above, each of thin flexible seals 300 may be manufactured and installed using readily available manufacturing methods and parts. For example, each thin flexible seal 300 may be bolted on the downstream side of turbine duct 102 and the upstream side of diffuser duct 104. In one embodiment, each of thin flexible seals 300 include oversized mounting apertures 304 and 320, such as holes or slots. Each of fastener assemblies 204 and 210 include oversized washers. In use, oversized mounting apertures 304 and 320 allow thin flexible seals 300 to grow thermally in the circumferential and axial directions yet remain firmly secured to turbine duct 102 and diffuser duct 104 via fastener assemblies 204 and 210, respectively.

Figure 4:
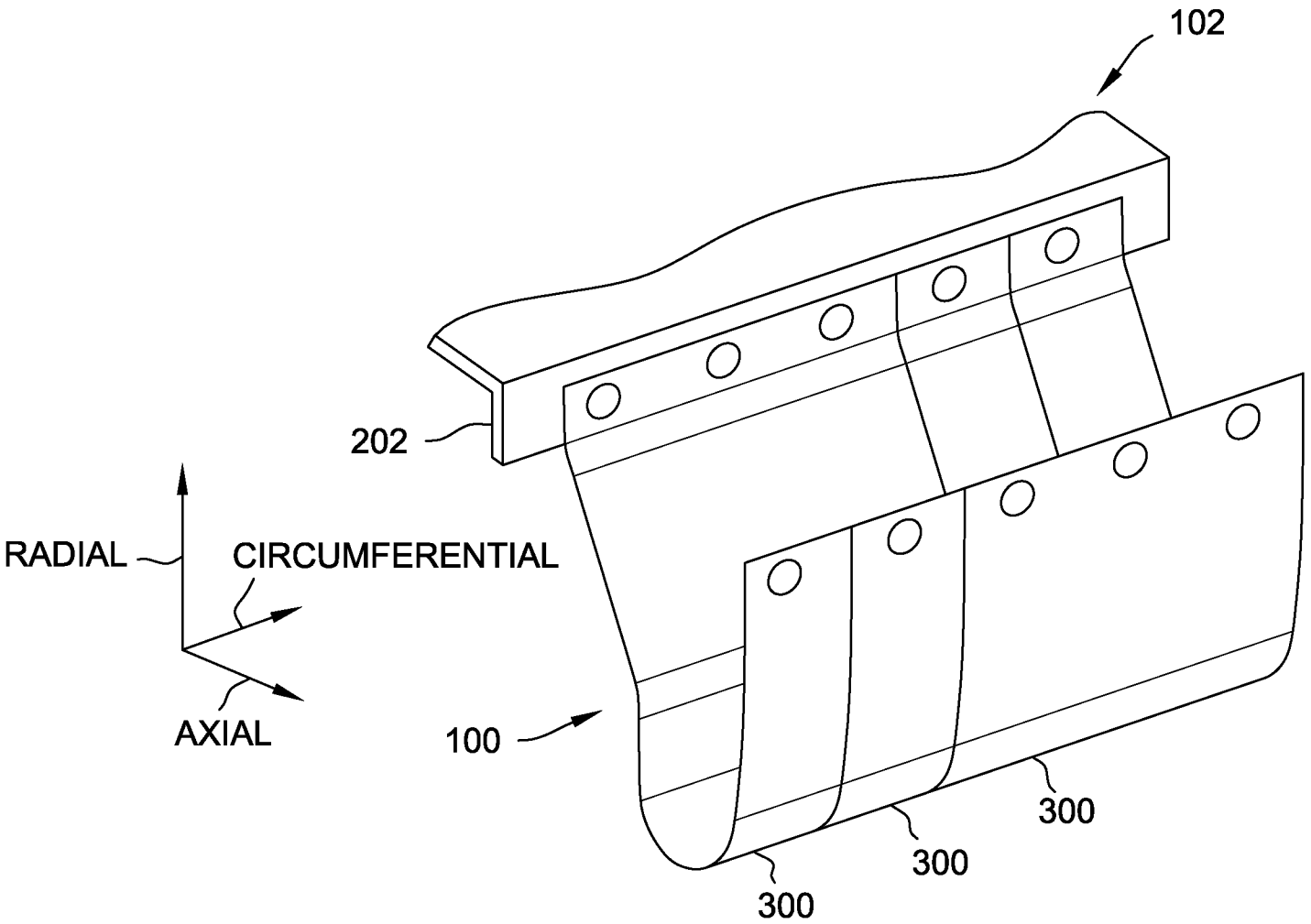
FIG. 4 is a perspective view of a plurality of the thin flexible seals shown in FIG. 3 coupled to the turbine duct shown in FIG. 1 at a radial flange and defining a portion of the expansion joint shown in FIG. 2.

FIG. 4 is a perspective view of a plurality of thin flexible seals 300 coupled to turbine duct 102 at radial flange 202 and defining a portion of expansion joint 100. In the exemplary embodiment, a plurality of thin flexible seals 300 are coupled together in overlapping layers. As such, expansion joint 100 includes three axially aligned layers of thin flexible seals 300. Each layer includes a plurality of thin flexible seals 300 coupled adjacent each other in a circumferential array to turbine duct 102 at radial flange 202, and radial flange 208 of diffuser duct 104. As shown in FIG. 2, each thin flexible seal 300 has a generally arcuate shape such that a given layer of expansion joint 100 includes an arcuate segment, such as thin flexible seal 300, in edge-abutting relationship with a circumferentially adjacent segment.

As described above, thin flexible seals 300 are arranged in multiple overlapping layers about the circumference of radial flange 208 of diffuser duct 104 and turbine duct 102 at a radial flange 202. The thickness and the arc length of thin flexible seals 300 have been selected to allow the thin flexible seals 300 to create a gas seal during gas turbine operation. This configuration creates a compact metal "diaphragm" capable of relatively large axial and radial movements, and which results in an efficient use of space.

Specifically, in the exemplary embodiment, thin flexible seals 300 are secured to turbine duct 102 at a radial flange 202 with a first layer of thin flexible seals 300 having an approximate thickness in the range between and including about 0.5 millimeters (mm) (0.020 in.) and about 1.5 mm (0.060 in.). The circumferential extent of each of thin flexible seals 300 is determined at least in part by the number of holes in radial flange 202 and radial flange 208, and the number of mounting apertures 304 and 320 in each thin flexible seal 300. For example, in one particular embodiment, each of flanges 202 and 208 include 120 mounting holes. As such, the first layer (and each subsequent layer) of thin flexible seals 300 include forty thin flexible seals 300 adjacent one another to form a complete circumferential array.

A second layer of thin flexible seals 300 having an approximate thickness in the range between and including about 0.5 mm (0.020 in.) and about 1.5 mm (0.060 in.) also includes forty thin flexible seals 300 adjacent one another, but with the thin flexible seals 300 of this second layer shifted circumferentially so that there is an overlap between the first and second layers at the radial seams of thin flexible seals 300 in the respective layers. In addition, a third layer of thin flexible seals 300 having an approximate thickness in the range between and including about 0.5 mm (0.020 in.) and about 1.5 mm (0.060 in.) also includes forty thin flexible seals 300 adjacent one another, and this third layer is circumferentially shifted with respect to the first and second layers so that, again, there is an overlap between the radial seams between the first, second, and third layers. The first and third layers need not be shifted, however, and they may be aligned, for example.

In some embodiments, clamp down bar assemblies (not shown) having a configuration similar to radial flange 202 and radial flange 208, may be used to facilitate securing thin flexible seals 300 in place. In such an embodiment, the three layers of thin flexible seals 300 are sandwiched between the clamp down bar assemblies and radial flanges 202 and 208.

It is noted, that while each thin flexible seal 300 is described having three mounting apertures in each of flange portion 302 and aft wall 318, the number and spacing of mounting apertures 304 and 320 in each thin flexible seal 300 is determined by the configuration of the radial flanges 202 and 208 of the specific gas turbine engine. If, for example, in one embodiment, there are eighty-six mounting holes in the radial flanges 202 and 208 of the turbine duct and exhaust diffuser duct flanges, at least one of the thin flexible seal 300 will have two rather than three mounting apertures, as well as a smaller arc length than the remaining thin flexible seals 300 in the layer. In the example embodiment, for example, the number of holes is divisible by three (120 holes, as described above), and there are forty three-aperture thin flexible seals 300, each having identical arc lengths.

Figure 5:
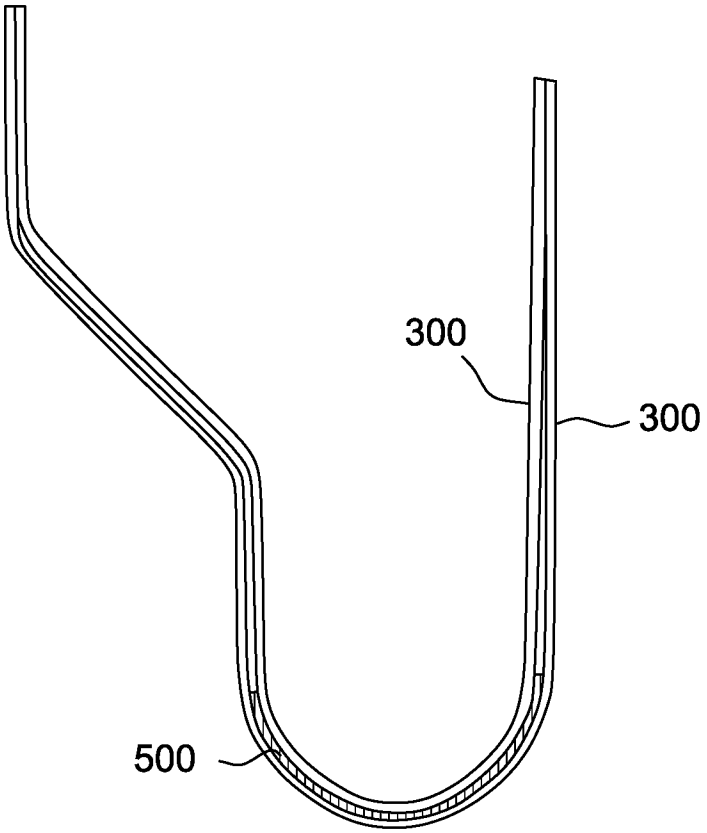
FIG. 5 is an end view of two thin flexible seals coupled together as shown in FIG. 4.

FIG. 5 is an end view of two thin flexible seals 300 coupled together as described above in FIG. 4. In the exemplary embodiment, a gasket 500, and in particular a tape gasket, is coupled between thin flexible seals 300. Gasket 500 is fabricated from a high temperature gasket material, and in some embodiments, includes an adhesive layer on one or more sides of gasket 500, to facilitate, for example, coupling gasket 500 to a component. In the exemplary embodiment, gasket 500 is elastic, provides for low water absorption, low water content, leak free, compressible, and includes surface tackiness. Gasket 500 may be metallic or nonmetallic. As shown in FIG. 5, gasket 500 is placed at least in the trough portion between thin flexible seals 300 to facilitate avoiding leakage of water wash fluid and/or liquid fuel that may enter the diffuser after a false start. Alternatively, gasket 500 is placed along the entire surface between stacked thin flexible seals 300.

Figure 6:
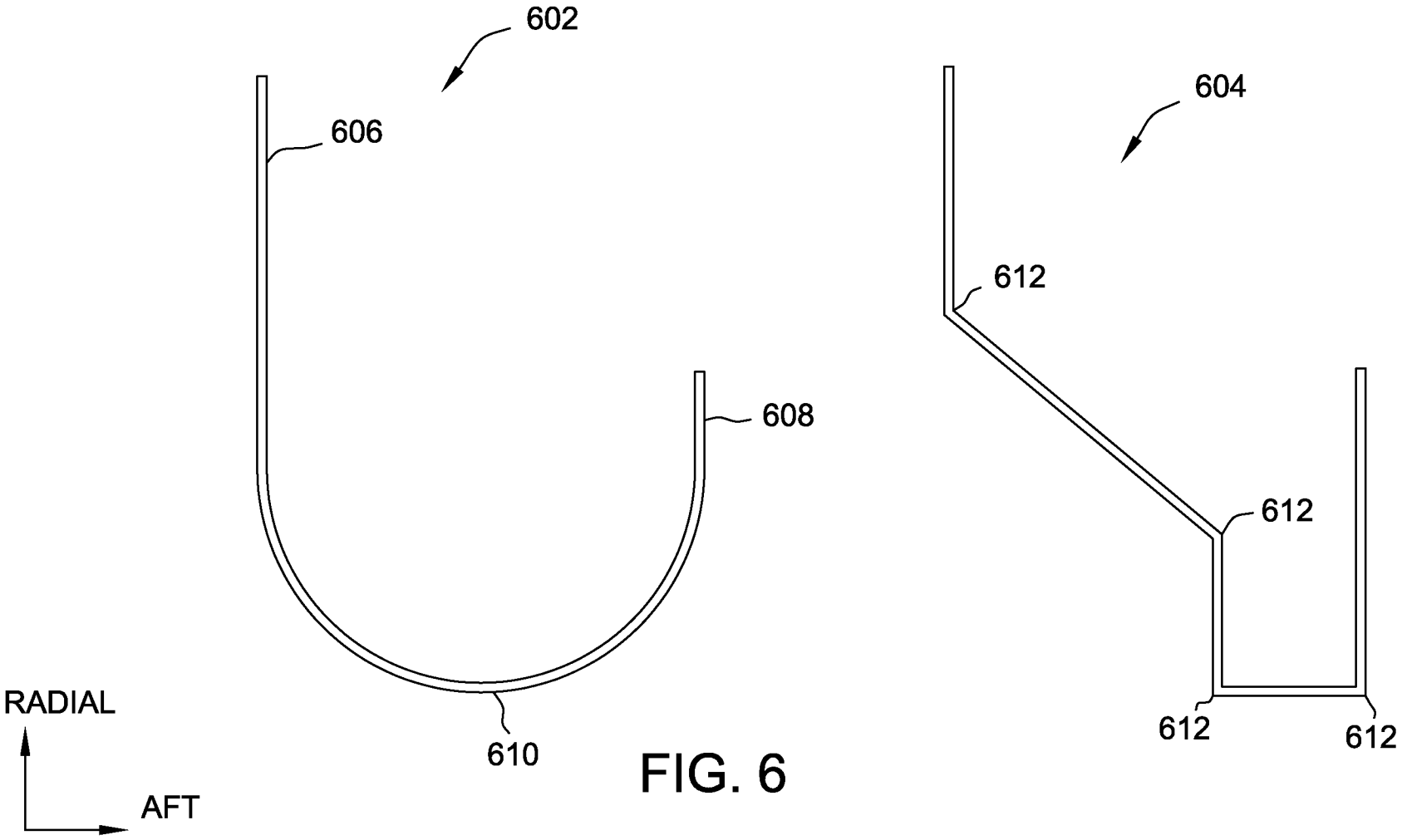
FIG. 6 is a side view of two alternative shape profiles for the thin flexible seal shown in FIG. 3.

FIG. 6 is a side view of two alternative shape profiles 602 and 604, for example, for thin flexible seal 300 (shown in FIG. 3). In the exemplary embodiment, shape profile 602 includes an upstream wall 606, a substantially parallel downstream wall 608, and a constant radius 610 between walls 606 and 608. Shape profile 604 is similar to thin flexible seal 300 (shown in FIG. 3) except that it is fabricated using sharp bends 612, such as those generated by the use of a metal brake. The shape profiles 602 and 604 may, in some embodiments, facilitate ease of manufacturing, reduced cost, and efficient assembly and disassembly of expansion joint 100.

In operation, when expansion joint 100 is cold and gas turbine engine 10 (shown in FIG. 1) is not operating, a gap 216 (shown in FIG. 3) exists in the flow path between turbine duct 102 and a diffuser duct 104. Gap 216 allows for drainage of liquid fuel if a false start should occur. Likewise, water from a turbine wash may drain out. When gas turbine engine 10 runs and becomes hot however, turbine duct 102 experiences thermal expansion. As a result, radial flange 202 of turbine duct 102 moves aft towards diffuser duct 104. Gap 216 between turbine duct 102 and a diffuser duct 104 thus narrows. In alternative embodiments, other dimensions may be used.

Exemplary embodiments of a flexible expansion joint are described herein. The embodiments includes a plurality of stacked and circumferential offset thin flexible seals operable to accommodate the large relative axial, vertical, and lateral displacements due to thermal expansion between the gas turbine engine, and in particular the turbine duct and the exhaust diffuser duct. In addition, the expansion joint provides a reliable way to drain all liquids that may enter the diffuser duct. The embodiments of the expansion joint described herein offers reliable, long term performance. The seal formed by the thin flexible seals accommodates more relative motion between adjacent ducts than prior techniques, and facilitates providing a smooth aerodynamic transition between the ducts. The thin flexible seals are shaped facilitate optimizing the low cycle fatigue (LCF) of expansion joint.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. For example, components of each system and/or steps of each method may be used and/or practiced independently and separately from other components and/or steps described herein. Additionally, while various embodiments of the disclosure have been described, it is to be understood that aspects of the disclosure may include only some of the described embodiments, and that each component and/or step may also be used and/or practiced with other systems and methods. Accordingly, the disclosure is not to be seen as limited by the foregoing description, but is only limited by the scope of the appended claims.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

While the disclosure has been described in terms of various specific embodiments, those skilled in the art will recognize that the disclosure can be practiced with modification within the spirit and scope of the claims. Although specific features of various embodiments of the disclosure may be shown in some drawings and not in others, this is for convenience only. Moreover, references to "one embodiment" or "an embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

What is claimed is:

1. An expansion joint for use between a turbine duct and a diffuser duct, said expansion joint comprising:

a first flange coupled to the turbine duct;

a second flange coupled to the diffuser duct; and a flexible element positioned between and coupled to said first flange of the turbine duct and said second flange of the diffuser duct, said flexible element defining a trough for receiving a liquid therein, said trough comprising a drain pipe configured to channel the liquid away from said trough;

wherein said flexible element comprises a plurality of flexible seals coupled to said first flange and said second flange; and wherein each flexible seal of said plurality of flexible seals is formed from a single sheet component and comprises a curved profile shape comprising a radius configured to optimize a low cycle fatigue of the expansion joint.

2. The expansion joint in accordance with claim 1, wherein said each flexible seal of said plurality of flexible seals comprises a plurality of apertures therein.

3. The expansion joint in accordance with claim 1, wherein said plurality of flexible seals comprises a first layer of flexible seals forming a first complete circumferential array, and a second layer of flexible seals forming a second complete circumferential array; and wherein each flexible seal of said second layer of flexible seals overlaps a radial seam defined between adjacent flexible seals of said first layer of flexible seals.

4. The expansion joint in accordance with claim 3, wherein said plurality of flexible seals further comprises a third layer of flexible seals forming a third complete circumferential array, wherein each flexible seal of said third layer of flexible seals overlaps a radial seam defined between adjacent flexible seals of said second layer of flexible seals.

5. The expansion joint in accordance with claim 3, further comprising a gasket positioned between at least one flexible seal of said first layer of flexible seals and at least one flexible seal of said second layer of flexible seals.

6. The expansion joint in accordance with claim 1, wherein said flexible element comprises at least one of a nickel based alloy and stainless steel.

7. A gas turbine engine comprising:

a turbine duct comprising a first flange coupled to a downstream portion of said turbine duct;

a diffuser duct comprising a second flange coupled to an upstream portion of said diffuser duct; and an expansion joint extending between said turbine duct and said diffuser duct, said expansion joint comprising a plurality of flexible seals coupled to said first flange and said second flange, said expansion joint defining a trough for receiving a liquid therein, said trough comprising a drain pipe configured to channel the liquid away from said trough;

wherein each flexible seal of said plurality of flexible seals is fabricated from a single sheet component and comprises a curved profile shape comprising a radius configured to optimize a low cycle fatigue of the expansion joint.

8. The gas turbine engine in accordance with claim 7, wherein said each flexible seal of said plurality of flexible seals comprises a plurality of apertures therein.

9. The gas turbine engine in accordance with claim 7, wherein said expansion joint comprises a plurality of layers of said plurality of flexible seals.

10. The gas turbine engine in accordance with claim 9, wherein said plurality of layers comprises three layers.

11. The gas turbine engine in accordance with claim 10, wherein said plurality of flexible seals of each layer of said plurality of layers are circumferentially offset from said plurality of flexible seals of an adjacent layer.

12. The gas turbine engine in accordance with claim 9, further comprising a gasket positioned between at least one flexible seal of a first layer of said plurality of layers and at least one flexible seal of a second layer of plurality of layers.

13. The gas turbine engine in accordance with claim 7, wherein said plurality of flexible seals comprise at least one of a nickel based alloy and stainless steel.

14. A method of assembling an expansion joint for use between a turbine duct and a diffuser duct, said method comprising:

coupling a first flange to the turbine duct;

coupling a second flange to the diffuser duct;

coupling a flexible element to the first flange of the turbine duct and the second flange of the diffuser duct, wherein the flexible element defines a trough for receiving a liquid therein, wherein coupling the flexible element to the first flange of the turbine duct and the second flange of the diffuser duct comprises coupling a plurality of flexible seals to the first flange of the turbine duct and the second flange of the diffuser duct; and coupling a drain pipe to the trough to channel the liquid away from the trough; and wherein each flexible seal of the plurality of flexible seals is formed from a single sheet component and includes a curved profile having a radius configured to optimize a low cycle fatigue of the expansion joint.

15. The method in accordance with claim 14, wherein coupling the plurality of flexible seals comprises:

coupling a first layer of the plurality of flexible seals to the first flange of the turbine duct and the second flange of the diffuser duct forming a first complete circumferential array; and coupling a second layer of flexible seals to the first flange of the turbine duct and the second flange of the diffuser duct forming a second complete circumferential array, wherein each flexible seal of the second layer of flexible seals overlaps a radial seam defined between adjacent flexible seals of the first layer of flexible seals.

* * * * *